US011359167B2

(12) United States Patent
Dimitrova et al.

(10) Patent No.: US 11,359,167 B2
(45) **Date of Patent: *Jun. 14, 2022**

(54) FABRIC-CARE COMPOSITION COMPRISING SILICONE MATERIALS

(71) Applicant: DOW SILICONES CORPORATION, Midland, MI (US)

(72) Inventors: Tatiana Dimitrova, Seneffe (BE); Jonathan Thill, Seneffe (BE); Severine Cauvin, Seneffe (BE)

(73) Assignee: DOW SILICONES CORPORATION, Midland, MI (US)

( * ) Notice: Subject to any disclaimer, the term of this patent is extended or adjusted under 35 U.S.C. 154(b) by 29 days.

This patent is subject to a terminal disclaimer.

(21) Appl. No.: 16/955,845

(22) PCT Filed: Dec. 17, 2018

(86) PCT No.: PCT/US2018/065956

§ 371 (c)(1),
(2) Date: Jun. 19, 2020

(87) PCT Pub. No.: WO2019/126014

PCT Pub. Date: Jun. 27, 2019

(65) Prior Publication Data

US 2020/0339915 A1 Oct. 29, 2020

Related U.S. Application Data

(60) Provisional application No. 62/608,601, filed on Dec. 21, 2017.

(51) Int. Cl.

| | |
|---|---|
| ***C11D 3/37*** | (2006.01) |
| ***C11D 3/00*** | (2006.01) |
| ***C11D 11/00*** | (2006.01) |
| ***C11D 17/00*** | (2006.01) |
| ***D06M 15/643*** | (2006.01) |
| *D06M 101/06* | (2006.01) |

(52) U.S. Cl.

CPC ..... *C11D 3/373* (2013.01); *C11D 3/0015* (2013.01); *C11D 11/0017* (2013.01); *C11D 17/0017* (2013.01); *D06M 15/643* (2013.01); *D06M 2101/06* (2013.01)

(58) Field of Classification Search

CPC ... C11D 3/373; C11D 3/0015; C11D 11/0017; C11D 17/0017

See application file for complete search history.

(56) References Cited

U.S. PATENT DOCUMENTS

| | | | |
|---|---|---|---|
| 4,247,442 | A | 1/1981 | Shimizu |
| 4,831,070 | A | 5/1989 | McInally et al. |
| 4,968,760 | A | 11/1990 | Schiller et al. |
| 5,138,009 | A | 8/1992 | Inoue |
| 5,223,495 | A | 6/1993 | Inoue et al. |
| 6,545,104 | B1 | 4/2003 | Mueller et al. |
| 7,740,664 | B2 | 6/2010 | Benabdillah |
| 9,005,639 | B2 | 4/2015 | Bekemeier et al. |
| 9,005,640 | B2 | 4/2015 | Bekemeier et al. |
| 10,889,738 | B2 | 1/2021 | Detemmerman et al. |
| 2002/0120057 | A1 | 8/2002 | Gosselink et al. |
| 2003/0065086 | A1 | 4/2003 | Kosal |
| 2004/0058845 | A1 | 3/2004 | Metrot et al. |
| 2005/0048124 | A1 | 3/2005 | Sarangapani |
| 2005/0288415 | A1 | 12/2005 | Beers et al. |
| 2007/0173596 | A1 | 7/2007 | Landon et al. |
| 2007/0212314 | A1 | 9/2007 | Murphy et al. |
| 2008/0295960 | A1 | 12/2008 | Schalau, II et al. |
| 2008/0311396 | A1 | 12/2008 | Hamada et al. |
| 2009/0004123 | A1 | 1/2009 | Manuszak et al. |
| 2010/0069531 | A1 | 3/2010 | Sakamoto et al. |
| 2010/0234517 | A1 | 9/2010 | Plantenberg et al. |
| 2011/0311723 | A1 | 12/2011 | Bekemeier et al. |
| 2012/0109036 | A1 | 5/2012 | Sambasivam et al. |
| 2013/0338289 | A1 | 12/2013 | Jadot et al. |
| 2014/0220843 | A1 | 8/2014 | Liu et al. |
| 2014/0350176 | A1 | 11/2014 | Fisher et al. |
| 2018/0215877 | A1 | 8/2018 | Hori et al. |
| 2019/0192387 | A1* | 6/2019 | Hori ..... A61K 8/891 |
| 2020/0063009 | A1 | 2/2020 | Detemmerman et al. |
| 2020/0339915 | A1 | 10/2020 | Dimitrova et al. |

FOREIGN PATENT DOCUMENTS

| | | | |
|---|---|---|---|
| CN | 1914281 | A | 2/2007 |
| CN | 104559910 | A | 4/2015 |
| CN | 104710960 | A | 6/2015 |

(Continued)

OTHER PUBLICATIONS

International Search Report for PCT/US2018/065956 dated Apr. 3, 2019, 4 pages.

N.J. Mills, "The Rheological Properties and Molecular Weight Distribution of Polydimethylsiloxane", European Polymer Journal, 1969, vol. 5, pp. 675-695.

Machine assisted English translation of CN1914281A obtained from https://patents.google.com/patent on Mar. 25, 2021, 27 pages.

Machine assisted English translation of CN104559910A obtained from https://patents.google.com/patent on Mar. 25, 2021, 5 pages.

Machine assisted English translation of CN104710960A obtained from https://patents.google.com/patent on Mar. 25, 2021, 7 pages.

Machine assisted English translation of CN104774587A obtained from https://patents.google.com/patent on Mar. 25, 2021, 7 pages.

(Continued)

*Primary Examiner* — John R Hardee

(74) *Attorney, Agent, or Firm* — Warner Norcross + Judd LLP

(57) ABSTRACT

The present disclosure relates to fabric-care compositions comprising an uncured silicone based polymer. In particular, the present disclosure relates to fabric-care compositions comprising at least one uncured silicone based polymer; and at least one fabric-care ingredient, optionally in an acceptable medium. Also disclosed are processes to prepare the fabric-care compositions and uses of the fabric-care compositions.

15 Claims, No Drawings

(56) References Cited

FOREIGN PATENT DOCUMENTS

| | | | |
|---|---|---|---|
| CN | 104774587 | A | 7/2015 |
| EP | 0315333 | A2 | 5/1989 |
| EP | 0425121 | A2 | 5/1991 |
| EP | 0802233 | A2 | 10/1997 |
| GB | 2518468 | A | 3/2015 |
| JP | S5676452 | A | 6/1981 |
| JP | S5676453 | A | 6/1981 |
| JP | 2008069869 | A | 3/2008 |
| WO | 2000024851 | A2 | 5/2000 |
| WO | 2000024856 | A1 | 5/2000 |
| WO | 2000024858 | A1 | 5/2000 |
| WO | 2003002809 | A1 | 1/2003 |
| WO | 2005021058 | A2 | 3/2005 |
| WO | 2008039654 | A2 | 4/2008 |
| WO | 2011051236 | A2 | 5/2011 |
| WO | 2012119940 | A1 | 9/2012 |
| WO | 2015082877 | A1 | 6/2015 |
| WO | 2016008022 | A1 | 1/2016 |
| WO | 2017018358 | A1 | 2/2017 |
| WO | 2017085296 | A1 | 5/2017 |
| WO | 2017221940 | A1 | 12/2017 |
| WO | 2019126010 | A1 | 6/2019 |

OTHER PUBLICATIONS

Machine assisted English translation of JPS5676452A obtained from https://worldwide.espacenet.com/patent on Oct. 18, 2021, 5 pages.

Machine assisted English translation of JPS5676453A obtained from https://worldwide.espacenet.com/patent on Jul. 23, 2020, 5 pages.

Machine assisted English translation of JP2008069869A obtained from https://patents.google.com/patent on Mar. 25, 2021, 6 pages.

Chen, Wei-Fu et al., "Covalently Cross-Linked Perfluorosulfonated Membranes with Polysiloxane Framework", Macromolecules 2007, vol. 40, No. 6, pp. 1987-1994.

Zhongzhan, Sun et al., "Synthesis and characterization of a new-type Schiff base side-chain polysiloxan[e] liquid crystal containing sulfonate groups", New Chemical Materials 2011, vol. 39, No. 5, pp. 56-58 (with English Abstract).

International Search Report for PCT/EP2016/078206 dated Jan. 26, 2017, 4 pages.

International Search Report for PCT/US2018/065950 dated Mar. 22, 2019, 4 pages.

* cited by examiner

FABRIC-CARE COMPOSITION COMPRISING SILICONE MATERIALS

CROSS-REFERENCE TO RELATED APPLICATIONS

This application is the National Stage of International Appl. No. PCT/US2018/065956 filed on 17 Dec. 2018, which claims priority to and all advantages of U.S. Appl. No. 62/608,601 filed on 21 Dec. 2017, the content of which is hereby incorporated by reference.

TECHNICAL FIELD

This disclosure relates to fabric-care compositions comprising at least one uncured silicone based polymer and at least one fabric-care ingredient, optionally in an acceptable medium. Also disclosed are processes to prepare the fabric-care compositions and uses of said fabric-care compositions.

BACKGROUND

Fabric-care compositions include fabric liquid detergents, solid detergents, pre-wash treatments, fabric softeners, colour care treatments and the like, used in the care of fabric and fibres, that is, any product adapted to be applied to a fibre, fabric or textile e.g. clothing, in order to improve the appearance or condition of the fabric or textile.

Silicone materials of various kinds may be used in fabric-care applications. These silicone materials vary in their polymeric structure, in their viscosity or consistency, and in a lot of general properties such as hardness, flowability, stickiness, compatibility. They may be adapted for use in a washing machine or for use when hand washing/rinsing/dyeing and may be in liquid, paste, laundry bar, granular and/or may be present in creams, gels, foams, sprays or aerosols. They may be in the form of monophasic systems, biphasic or alternate multi phasic systems; emulsions, e.g. oil-in-water, water-in-oil, silicone-in-water, water-in-silicone; multiple emulsions, e.g. oil-in-water-in-oil, polyol-in-silicone-in-water, oil-in-water-in-silicone.

Fabric-care compositions may be used in laundry processes to remove dirt, stains and malodours from fabrics or textiles, in particular clothes and household fabrics. However, the laundry process involves harsh conditions which often result in damage to the fabric such as fabric pilling, shrinkage and loss of colour intensity and/or loss of colour definition. A fabric-softening composition may be used in the laundry process to prevent static cling in a laundered fabric and thereby make the fabric softer. Colour-care additives are meant to retain the integrity of its colour, for example the intensity and shade of colour of the fabric.

Benefits obtained from using a fabric-care composition comprising a silicone based material may include fabric softening and/or feel enhancement, fabric protection, anti-stain effects, garment shape retention and/or recovery and/or elasticity, ease of ironing, colour care, anti-abrasion, anti-pilling, silicone deposition, water absorbency, reduction and/or removal and/or prevention of wrinkles fabric enhancement (or conditioning), or any combination thereof. In a dyeing process, benefits include colour fastness, colour absorbency, colour long lasting.

SUMMARY OF INVENTION

The present disclosure relates to fabric-care compositions comprising uncured silicone based polymers. In particular, the present disclosure relates to a fabric-care composition comprising an uncured silicone based polymer; and at least one fabric-care ingredient, optionally in a fabric-care acceptable medium; where the uncured silicone based polymer is linear or branched, having the formula $$(R^1O)_{3-x}—Si(R^2)_x—(Z)_d—(O)_q—(R^3{}_2SiO)_N—(SiR^3{}_2—Z)_d—Si(R^2)_y(OR^1)_{3-y}$$

In which:

x is 0 (zero) or 1;

y is 0, 1, 2, or 3;

N is from 300 to 10,000;

d is 0 or 1, q is 0 or 1 and d+q=1; $R^1$, $R^2$ and $R^3$ are each independently linear alkyl groups containing 1 to 10 carbons; and each Z is independently either (i) a linear or branched alkylene group having from 1 to 12 carbon atoms which may be interrupted by one or more linear or branched siloxane groups comprising from 1 to 20 silicon atoms; or (ii) an organic chain based on polyoxyalkylene based units which may be interrupted by one or more linear or branched siloxane groups comprising from 1 to 20 silicon atoms.

DESCRIPTION OF EMBODIMENTS

For the purpose of this invention fabric-care compositions include any product adapted to be applied to a fibre, fabric or textile e.g. clothing, in order to improve the appearance or condition of the fabric or textile. Examples of fabric-care compositions may include, for the sake of example, liquid detergents, solid detergents, pre-wash treatments, fabric softeners, colour care treatments and the like, used in the care of fabric and fibres. A fabric-care ingredient is an ingredient other than the uncured silicone based polymer as hereinbefore described which is used in a fabric-care composition, as will be discussed below.

The relationship of molecular weight to viscosity of polydimethylsiloxane is described in scientific literature, for example, in at least Mills, E., European Polymer Journal, 1969, vol. 5, p. 675-695. The formula published in this article can be used to calculate approximately the weight average molecular weight of polymers (Mw) with an accuracy of about 10%. The polydispersity index (PI) is the ratio Mw/Mn. From this relationship, the number average molecular weight (Mn) can be calculated.

The Mn and Mw of a silicone polymer can also be determined by Gel Permeation Chromatography (GPC) with a precision of about 10-15%. This technique is a standard technique, and yields values for Mw (weight average), Mn (number average) and polydispersity index (PI) (where PI=Mw/Mn).

Mn values provided in this application have been determined by GPC and represent a typical value of the polymer used. If not provided by GPC, the Mn may also be obtained from calculation based on the dynamic viscosity of said polymer.

The uncured silicone based polymer as hereinbefore described is linear or branched, having the formula $$(R^1O)_{3-x}—Si(R^2)_x—(Z)_d—(O)_q—(R^3{}_2SiO)_N—(SiR^3{}_2—Z)_d—Si(R^2)_y(OR^1)_{3-y}$$

In which:

x is 0 (zero) or 1;

y is 0, 1, 2, or 3;

N is from 300 to 10,000;

d is 0 or 1, q is 0 or 1, and d+q=1; $R^1$, $R^2$ and $R^3$ are each independently linear alkyl groups containing 1 to 10 carbons; and each Z is independently either (i) a linear or branched alkylene group having from 1 to 12 carbon atoms which may be interrupted by one or more linear or branched siloxane groups comprising from 1 to 20 silicon atoms; or (ii) an organic chain based on polyoxyalkylene based units which may be interrupted by one or more linear or branched siloxane groups comprising from 1 to 20 silicon atoms.

Whilst x may be 0 or 1, it is preferred for x to be 0. Whilst y may be 0, 1, 2 or 3, it is preferred that y is 0 or 3 or a mixture of 0 and 3. N is from 300 to 10,000, alternatively from 300 and 1000, alternatively from 500 to 1000, alternatively from 600 to 900.

$R^1$, $R^2$ and $R^3$ are independently linear alkyl groups containing 1 to 10 carbons, alternatively from 1 to 3 carbons, alternatively methyl or ethyl. In one embodiment $R^1$=methyl or ethyl, $R^2$=methyl and/or $R^3$=methyl. Blends of polymers having different values of x, y and N are included herein, in particular blends where x is 0 and y is 0 and/or 3.

In the case of both options of Z (hereafter referred to as Z(i) and Z(ii) respectively) the polymer chains may be interrupted by one or more linear or branched siloxane groups comprising from 1 to 20 silicon atoms), if present the linear or branched siloxane groups will be made up of units of the structure $—[R^5_aSiO_{(4-a)/2}]—$ where a can be from 2 to 4 and $R^5$ is either a saturated alkyl, or phenyl or alkoxysilyl fragment of the type $—(C_bH_{2b})_e—Si—(R^2)_v(OR^1)_{3-v}$, where b is from 1 to 10, e is zero or 1 and v is 0, 1 or 2. In such units typically a=2 resulting in a linear group of siloxane units. However, branching occurs when in one or more units a is zero or 1.

In one alternative Z(i) contains no linear or branched siloxane groups, i.e. Z(i) is a linear or branched alkylene group having from 1 to 12 carbon atoms, alternatively Z(i) is a linear or branched alkylene group having from 1 to 6 carbon atoms, Z(i) is a linear alkylene group having from 1 to 6 carbon atoms, alternatively Z(i) is a linear or branched alkylene group having from 2 to 4 carbon atoms.

When Z is Z(ii), Z(ii) may be an organic chain based on polyoxyalkylene based units such polyoxyalkylene units preferably comprise a linear predominantly oxyalkylene polymer comprised of recurring oxyalkylene units, $(—C_nH_{2n}—O—)$ illustrated by the average formula $(—C_nH_{2n}—O—)_m$ wherein n is an integer from 2 to 4 inclusive and m is an integer of at least four. The number average molecular weight of each polyoxyalkylene polymer block may range from about 300 to about 10,000, but can be higher in number average (Mn) molecular weight. Moreover, the oxyalkylene units are not necessarily identical throughout the polyoxyalkylene monomer, but can differ from unit to unit. A polyoxyalkylene block, for example, can be comprised of oxyethylene units, $(—C_2H_4—O—)$; oxypropylene units $(—C_3H_6—O—)$; or oxybutylene units, $(—C_4H_8—O—)$; or mixtures thereof. No particular tactility and/or blockiness of the polyglycol fragments is implied.

In one alternative Z(ii) contains no linear or branched siloxane groups, i.e. Z(ii) is a linear predominantly oxyalkylene polymer comprised of recurring oxyalkylene units. In Z(ii) there may be provided one of more alkylene groups having from 2 to 6 carbon atoms.

The general level of uncured silicone based polymer in the fabric-care compositions may vary from 0.1% to 50% by weight, alternatively from 0.1% to 20%, alternatively from 0.5% to 10%, alternatively from 0.5% to 5%, alternatively from 0.5% to 2%, relative to the total weight of the fabric-care composition.

The uncured silicone based polymer as hereinbefore described may be provided in presence of an extender. When used the extender may be added before, after or during the preparation of the polymer, However it does not contribute to or participate in the polymerisation process. For ease of handling, the extender may be added before the polymerisation reaction is initiated. Extenders as described herein are provided to dilute the polymer and prevent it from becoming too viscous during processing, i.e. further use.

Examples of extenders include (i) silicon containing liquids such as hexamethyldisiloxane, octamethyltrisiloxane, and other short chain linear siloxanes such as octamethyltrisiloxane, decamethyltetrasiloxane, dodecamethylpentasiloxane, tetradecamethylhexasiloxane, hexadeamethylheptasiloxane, heptamethyl-3-{(trimethylsilyl)oxy)}trisiloxane, cyclic siloxanes such as hexamethylcyclotrisiloxane, octamethylcyclotetrasiloxane, decamethylcyclopentasiloxane, dodecamethylcyclohexasiloxane; further polydiorganosiloxanes, optionally including aryl functional siloxanes, having a viscosity of from 500 to 12,500 mPa·s, measured at 25° C.; using Brookfield cone plate viscometer RV DIII using a cone plate CP-52 at 5 rpm;

(ii) Organic liquids such as butyl acetate, alkanes, alcohols, ketones, esters, ethers, glycols, glycol ethers, hydrocarbons, hydrofluorocarbons or any other material which can dilute the composition without adversely affecting any of the component materials. Hydrocarbons include isododecane, isohexadecane, Isopar L (C11-C13), Isopar H (C11-C12), hydrogenated polydecene, mineral oil, especially hydrogenated mineral oil or white oil, liquid polyisobutene, isoparaffinic oil or petroleum jelly. Ethers and esters include isodecyl neopentanoate, neopentylglycol heptanoate, glycol distearate, dicaprylyl carbonate, diethylhexyl carbonate, propylene glycol n butyl ether, ethyl-3 ethoxypropionate, propylene glycol methyl ether acetate, tridecyl neopentanoate, propylene glycol methylether acetate (PGMEA), propylene glycol methylether (PGME), octyldodecyl neopentanoate, diisobutyl adipate, diisopropyl adipate, propylene glycol dicaprylate/dicaprate, and octyl palmitate. Additional organic diluents include fats, oils, fatty acids, and fatty alcohols. A mixture of diluents may also be used.

The weight ratio of uncured silicone based polymer to extender can for example be 100/0 to 10/90, alternatively 70/30 to 20/80.

Fabric-care ingredients include surface active materials such as surfactants or detergents or emulsifiers, thickeners, water phase stabilizing agents, pH controlling agents, preservatives and biocides, proteins or amino-acids and their derivatives, pigments, colourants, silicone conditioning agents, cationic conditioning agents, non-ionic conditioning agents, hydrophobic conditioning agents, UV absorbers, sunscreen agents, dyes, fragrances or perfume, antioxidants, soil release agents, oxidizing agents, reducing agents, propellant gases, dispersibility aids, inorganic salts, antibacterial agents, antifungal agents, bleaching agents, sequestering agents, enzymes, diluents and mixtures thereof.

Examples of surface active materials may be anionic, cationic or non-ionic, and include organomodified silicones such as dimethicone copolyol; oxyethylenated and/or oxypropylenated ethers of glycerol; oxyethylenated and/or oxypropylenated ethers of fatty alcohols such as ceteareth-30, C12-15 pareth-7; fatty acid esters of polyethylene glycol such as PEG-50 stearate, PEG-40 monostearate; saccharide esters and ethers, such as sucrose stearate, sucrose cocoate and sorbitan stearate, and mixtures thereof; phosphoric esters and salts thereof, such as DEA oleth-10 phosphate; sulphosuccinates such as disodium PEG-5 citrate lauryl sulphosuccinate and disodium ricinoleamido MEA sulphosuccinate; alkyl ether sulphates, such as sodium lauryl ether sulphate; isethionates; betaine derivatives; and mixtures thereof.

Examples of non-ionic surfactants include polyoxyethylene alkyl ethers, polyoxyethylene fatty alcohols, polyoxyethylene alkylphenol ethers, polyoxyethylene lauryl ethers such as polyoxyethylene (23) lauryl ether, polyoxyethylene (4) lauryl ether, straight-chain, alkoxylated alcohols including primary alcohol alkoxylates, straight-chain secondary alcohol alkoxylates, alkyl phenol alkoxylates, olefinic alkoxylates, branched chain alkoxylates, specific examples including ethoxylated alcohols such as ethoxylated trimethylnonanol, C12-C14 secondary alcohol ethoxylates, ethoxylated, C10-Guerbet alcohol, ethoxylated, iso-C13 alcohol; poly(oxyethylene)-poly(oxypropylene)-poly(oxyethylene) tri-block copolymer (also referred to as poloxamers); tetra-functional poly(oxyethylene)-poly(oxypropylene) block copolymer derived from the sequential addition of propylene oxide and ethylene oxide to ethylene diamine (also referred to as poloxamines), silicone polyethers, and mixtures thereof. Further examples of non-ionic surfactants include polyoxyethylene sorbitan monoleates, polyoxyethylene alkyl esters, polyoxyethylene sorbitan alkyl esters, polyethylene glycol, polypropylene glycol, diethylene glycol, polyoxyalkylene-substituted silicones (rake or ABn types), silicone alkanolamides, silicone esters, silicone glycosides, and mixtures thereof.

Further examples of non-ionic surfactants include dimethicone copolyols, fatty acid esters of polyols, for instance sorbitol or glyceryl mono-, di-, tri- or sesquioleates or stearates, glyceryl or polyethylene glycol laurates; fatty acid esters of polyethylene glycol (polyethylene glycol monostearate or monolaurate); polyoxyethylenated fatty acid esters (stearate or oleate) of sorbitol; polyoxyethylenated alkyl (lauryl, cetyl, stearyl or octyl)ethers, condensates of ethylene oxide with long chain fatty alcohols or fatty acids such as a C12-16 alcohol, condensates of ethylene oxide with an amine or an amide, condensation products of ethylene and propylene oxide, esters of glycerol, sucrose, sorbitol, fatty acid alkylol amides, sucrose esters, fluoro-surfactants, fatty amine oxides, and mixtures thereof.

Examples of cationic surfactants include alkylamine salts, quaternary ammonium salts, sulphonium salts, and phosphonium salts.

Examples of anionic surfactants include carboxylates (sodium 2-(2-hydroxyalkyloxy)acetate)), amino acid derivatives (N-acylglutamates, N-acylgly-cinates or acylsarcosinates), alkyl sulphsulphates, alkyl ether sulphsulphates and oxyethylenated derivatives thereof, sulphsulphonates, isethionates and N-acylisethionates, taurates and N-acyl N-methyltaurates, sulphsulphosuccinates, alkylsulphsulphoacetates, phosphates and alkyl phosphates, polypeptides, anionic derivatives of alkyl polyglycoside (acyl-D-galactoside uronate), and fatty acid soaps, and mixtures thereof, alkali metal, amine, or ammonium salts of higher fatty acids, alkylaryl sulphonates such as sodium dodecyl benzene sulphsulphonate, long chain fatty alcohol sulphsulphates, olefin sulphsulphates and olefin sulphsulphonates, sulphsulphated monoglycerides, sulphsulphated esters, sulphsulphonated ethoxylated alcohols, sulphsulphosuccinates, alkane sulphsulphonates, phosphate esters, alkyl isethionates, alkyl taurates, alkyl sarcosinates, and mixtures thereof.

Amphoteric and zwitterionic surfactants include betaines, N-alkylamidobetaines and derivatives thereof, proteins and derivatives thereof, glycine derivatives, sultaines, alkyl polyaminocarboxylates and alkylamphoacetates, imidazoline compounds, alkylaminoacid salts, and mixtures thereof.

Examples of thickeners include acrylamide polymers and copolymers, acrylate copolymers and salts thereof (such as sodium polyacrylate), xanthan gum and derivatives, cellulose gum and cellulose derivatives (such as methylcellulose, methylhydroxypropylcellulose, hydroxypropylcellulose, polypropylhydroxyethylcellulose), starch and starch derivatives (such as hydroxyethylamylose and starch amylase), polyoxyethylene, carbomer, hectorite and hectorite derivatives, sodium alginate, arabic gum, cassia gum, guar gum and guar gum derivatives, cocamide derivatives, alkyl alcohols, gelatin, PEG-derivatives, saccharides (such as fructose, glucose) and saccharides derivatives (such as PEG-120 methyl glucose diolate), and mixtures thereof.

Examples of water phase stabilizing agents include electrolytes (e.g. alkali metal salts and alkaline earth salts, especially the chloride, borate, citrate, and sulphsulphate salts of sodium, potassium, calcium and magnesium, as well as aluminium chlorohydrate, and polyelectrolytes, especially hyaluronic acid and sodium hyaluronate), polyols (glycerine, propylene glycol, butylene glycol, and sorbitol), alcohols such as ethyl alcohol, and hydrocolloids, and mixtures thereof.

Examples of pH controlling agents include any water soluble acid such as a carboxylic acid or a mineral acid such as hydrochloric acid, sulphuric acid, and phosphoric acid, monocarboxylic acid such as acetic acid and lactic acid, and polycarboxylic acids such as succinic acid, adipic acid, citric acid, and mixtures thereof.

Example of preservatives and biocides include paraben derivatives, hydantoin derivatives, chlorhexidine and its derivatives, imidazolidinyl urea, phenoxyethanol, silver derivatives, salicylate derivatives, triclosan, ciclopirox olamine, hexamidine, oxyquinoline and its derivatives, PVP-iodine, zinc salts and derivatives such as zinc pyrithione, glutaraldehyde, formaldehyde, 2-bromo-2-nitropropane-1,3-diol, 5-chloro-2-methyl-4-isothiazoline-3-one, 2-methyl-4-isothiazoline-3-one, and mixtures thereof.

Examples of proteins or amino-acids and their derivatives include those extracted from wheat, soy, rice, corn, keratin, elastin or silk. Proteins may be in the hydrolysed form and they may also be quaternized, such as hydrolysed elastin, hydrolysed wheat powder, hydrolysed silk. Examples of protein include enzymes such as hydrolases, cutinases, oxidases, transferases, reductases, hemicellulases, esterases, isomerases, pectinases, lactases, peroxidases, laccases, catalases, and mixtures thereof. Examples of hydrolases include proteases (bacterial, fungal, acid, neutral or alkaline), amylases (alpha or beta), lipases, mannanases, cellulases, collagenases, lisozymes, superoxide dismutase, catalase, and mixtures thereof.

Examples of pigments and colourants include surface treated or untreated iron oxides, surface treated or untreated titanium dioxide, surface treated or untreated mica, silver oxide, silicates, chromium oxides, carotenoids, carbon black, ultramarines, chlorophyllin derivatives and yellow ocher. Examples of organic pigments include aromatic types including azo, indigoid, triphenylmethane, anthraquinone, and xanthine dyes which are designated as D&C and FD&C blues, browns, greens, oranges, reds, yellows, etc., and mixtures thereof. Surface treatments include those treatments based on lecithin, silicone, silanes, fluoro compounds.

Examples of silicone conditioning agents include silicone oils such as dimethicone; silicone gums such as dimethiconol; silicone resins such as trimethylsiloxy silicate, polypropyl silsesquioxane; silicone elastomers; alkylmethylsiloxanes; organomodified silicone oils, such as amodimethicone, aminopropyl phenyl trimethicone, phenyl trimethicone, trimethyl pentaphenyl trisiloxane, silicone quaternium-16/glycidoxy dimethicone crosspolymer, silicone quaternium-16; saccharide functional siloxanes; carbinol functional siloxanes; silicone polyethers; siloxane copolymers (divinyldimethicone/dimethicone copolymer); acrylate or acrylic functional siloxanes; and mixtures or emulsions thereof.

Examples of cationic conditioning agents include guar derivatives such as hydroxypropyltrimethylammonium derivative of guar gum; cationic cellulose derivatives, cationic starch derivatives; quaternary nitrogen derivatives of cellulose ethers; quaternized triethanolamine esters (esterquats); homopolymers of dimethyldiallyl ammonium chloride; copolymers of acrylamide and dimethyldiallyl ammonium chloride; homopolymers or copolymers derived from acrylic acid or methacrylic acid which contain cationic nitrogen functional groups attached to the polymer by ester or amide linkages; polymeric quaternary ammonium salts of hydroxyethyl cellulose reacted with a fatty alkyl dimethyl ammonium substituted epoxide; polycondensation products of N,N'-bis-(2,3-epoxypropyl)-piperazine or piperazine-bis-acrylamide and piperazine; and copolymers of vinylpyrrolidone and acrylic acid esters with quaternary nitrogen functionality. Specific materials include the various polyquats Polyquaternium-7, Polyquaternium-8, Polyquaternium-10, Polyquaternium-11, and Polyquaternium-23. Other categories of conditioners include cationic surfactants such as cetyl trimethylammonium chloride, cetyl trimethylammonium bromide, stearyltrimethylammonium chloride, and mixtures thereof. In some instances, the cationic conditioning agent is also hydrophobically modified, such as hydrophobically modified quaternized hydroxyethylcellulose polymers; cationic hydrophobically modified galactomannan ether; and mixtures thereof.

Examples of non-ionic conditioning agents include fatty acid partial esters of polyhydric alcohols, or anhydrides thereof, where the polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan and where the fatty acid portion of the ester is derived from fatty acids having from about 12 to about 30 carbon atoms, such as lauric acid, myristic acid, palmitic acid, stearic acid and behenic acid.

Examples of hydrophobic conditioning agents include guar derivatives; galactomannan gum derivatives; cellulose derivatives; and mixtures thereof.

Examples of fabric softening compounds include cationic and non-ionic compounds. Further examples of fabric softening compounds include polyalkyl quaternary ammonium salts such as distearyldimethyl ammonium chloride, di(hardened tallow alkyl) dimethyl ammonium chloride, dipalmityl hydroxyethyl methylammonium chloride, stearyl benzyl dimethylammonium chloride, N,N-di(tallowyl-oxy-ethyl)-N-methyl, N-(2-hydroxyethyl)ammonium chloride; ester-linked quaternary ammonium materials having one or more fully saturated alkyl chains, and mixtures thereof.

UV absorbers and sunscreen agents include those which absorb ultraviolet light between about 290-320 nanometers (the UV-B region) and those which absorb ultraviolet light in the range of 320-400 nanometers (the UV-A region).

Some examples of sunscreen agents are aminobenzoic acid, cinoxate, diethanolamine methoxycinnamate, digalloyl trioleate, dioxybenzone, ethyl 4-[bis(Hydroxypropyl)]aminobenzoate, glyceryl aminobenzoate, homosalate, lawsone with dihydroxyacetone, menthyl anthranilate, octocrylene, ethyl hexyl methoxycinnamate, octyl salicylate, oxybenzone, padimate O, phenylbenzimidazole sulphsulphonic acid, red petrolatum, sulisobenzone, titanium dioxide, trolamine salicylate, and mixtures thereof.

Some examples of UV absorbers are acetaminosalol, allatoin PABA, benzalphthalide, benzophenone, benzophenone 1-12, 3-benzylidene camphor, benzylidenecamphor hydrolysed collagen sulphsulphonamide, benzylidene camphor sulphsulphonic Acid, benzyl salicylate, bornelone, bumetriozole, butyl Methoxydibenzoylmethane, butyl PABA, ceria/silica, ceria/silica talc, cinoxate, DEA-methoxycinnamate, dibenzoxazol naphthalene, di-t-butyl hydroxybenzylidene camphor, digalloyl trioleate, diisopropyl methyl cinnamate, dimethyl PABA ethyl cetearyldimonium tosylate, dioctyl butamido triazone, diphenyl carbomethoxy acetoxy naphthopyran, disodium bisethylphenyl tiamminotriazine stilbenedisulphsulphonate, disodium distyrylbiphenyl triaminotriazine stilbenedisulphsulphonate, disodium distyrylbiphenyl disulphsulphonate, drometrizole, drometrizole trisiloxane, ethyl dihydroxypropyl PABA, ethyl diisopropylcinnamate, ethyl methoxycinnamate, ethyl PABA, ethyl urocanate, etrocrylene ferulic acid, glyceryl octanoate dimethoxycinnamate, glyceryl PABA, glycol salicylate, homosalate, isoamyl p-methoxycinnamate, isopropylbenzyl salicylate, isopropyl dibenzolylmethane, isopropyl methoxycinnamate, menthyl anthranilate, menthyl salicylate, 4-methylbenzylidene, camphor, octocrylene, octrizole, octyl dimethyl PABA, ethyl hexyl methoxycinnamate, octyl salicylate, octyl triazone, PABA, PEG-25 PABA, pentyl dimethyl PABA, phenylbenzimidazole sulphsulphonic acid, polyacrylamidomethyl benzylidene camphor, potassium methoxycinnamate, potassium phenylbenzimidazole sulphsulphonate, red petrolatum, sodium phenylbenzimidazole sulphsulphonate, sodium urocanate, TEA-phenylbenzimidazole sulphsulphonate, TEA-salicylate, terephthalylidene dicamphor sulphsulphonic acid, titanium dioxide, triPABA panthenol, urocanic acid, VA/crotonates/methacryloxybenzophenone-1 copolymer, and mixtures thereof.

A dye may generally be described as a coloured substance that has an affinity to the substrate to which it is being applied. Examples of dyes include anionic dyes (for example a direct dye or an acid dye), reactive dyes, non-ionic dyes (for example a disperse dye) or pigment dyes (for example a vat dye). Direct dyes are generally large, planar, aromatic systems generally used to dye cotton, for example direct red 80 or direct black 56. Reactive dyes are medium sized generally used for cotton and wool having fibre-reactive terminal group which forms a covalent bond with an atom of the fabric, for example remazol brilliant blue R and procion blue 3G. Disperse dyes are compact, aromatic molecules used for polyester, or dark shades on nylon and include disperse blue 11. Vat dyes are used for cotton, mainly prints and denims. The water-soluble reduced form is oxidised in situ to form the insoluble dye. Examples include vat blue 4. Further examples of dyes include indigo extract, Lawsonia inermis (Henna) extract, 1-acetoxy-2-methylnaphthalene; 5-amino-4-chloro-o-cresol; 5-amino-2,6-dimethoxy-3-hydroxypyridine; 3-amino-2,6-dimethylphenol; 2-amino-5-ethylphenol HCl; 5-amino-4-fluoro-2-methylphenol sulphsulphate; 4-amino-2-nitrophenol; 4-amino-3-nitrophenol; 2-amino-4-nitrophenol sulphsulphate; m-aminophenol HCl; p-aminophenol HCl; m-aminophenol; o-aminophenol; 4,6-bis(2-hydroxyethoxy)-m-phenylenediamine HCl; 2-chloro-5-nitro-N-hydroxyethyl p-phenylenediamine; 2-chloro-p-phenylenediamine; 3,4-diaminobenzoic acid; 4,5-diamino-1-((4-chlorophenyl) methyl)-1H-pyrazole-sulphsulphate; 2,3-diaminodihydropyrazolo pyrazolone dimethosulphsulphonate; 2,6-diaminopyridine; 2,6-diamino-3-((pyridin-3-yl)azo) pyridine; dihydroxyindole; dihydroxyindoline; N,N-dimethyl-p-phenylenediamine; 2,6-dimethyl-p-phenylenediamine; N,N-dimethyl-p-phenylenediamine sulphsulphate; direct dyes; 4-ethoxy-m-phenylenediamine sulphsulphate; 3-ethylamino-p-cresol sulphsulphate; N-ethyl-3-nitro PABA; gluconamidopropyl aminopropyl dimethicone; Haematoxylon brasiletto wood extract; HC dyes; hydroxyethyl-3,4-methylenedioxyaniline HCl; hydroxyethyl-2-nitro-p-toluidine; hydroxyethyl-p-phenylenediamine sulphsulphate; 2-hydroxyethyl picramic acid; hydroxypyridinone; hydroxysuccinimidyl C21-22 isoalkyl acidate; isatin; Isatis tinctoria leaf powder; 2-methoxymethyl-p-phenylenediamine sulphsulphate; 2-methoxy-p-phenylenediamine sulphsulphate; 6-methoxy-2,3-pyridinediamine HCl; 4-methylbenzyl 4,5-diamino pyrazole sulphsulphate; 2,2'-methylenebis 4-aminophenol; 2,2'-methylenebis-4-aminophenol HCl; 3,4-methylenedioxyaniline; p-phenylenediamine sulphsulphate; phenyl methyl pyrazolone; N-phenyl-p-phenylenediamine HCl; pigment blue 15:1; pigment violet 23; pigment yellow 13; pyrocatechol; pyrogallol; resorcinol; sodium picramate; sodium sulphsulphanilate; solvent yellow 85; solvent yellow 172; tetraaminopyrimidine sulphsulphate; tetrabromophenol blue; 2,5,6-triamino-4-pyrimidinol sulphsulphate; 1,2,4-trihydroxybenzene; and mixtures thereof.

Examples of fragrances or perfume include hexyl cinnamic aldehyde; anisaldehyde; methyl-2-n-hexyl-3-oxo-cyclopentane carboxylate; dodecalactone gamma; methylphenylcarbinyl acetate; 4-acetyl-6-tert-butyl-1,1-dimethyl indane; patchouli; olibanum resinoid; labdanum; vetivert; copaiba balsam; fir balsam; 4-(4-hydroxy-4-methyl pentyl)-3-cyclohexene-1-carboxaldehyde; methyl anthranilate; geraniol; geranyl acetate; linalool; citronellol; terpinyl acetate; benzyl salicylate; 2-methyl-3-(p-isopropylphenyl)-propanal; phenoxyethyl isobutyrate; cedryl acetal; aubepine; musk fragrances; macrocyclic ketones; macrolactone musk fragrances; ethylene brassylate; and mixtures thereof.

Examples of antioxidants are acetyl cysteine, arbutin, ascorbic acid, ascorbic acid polypeptide, ascorbyl dipalmitate, ascorbyl methylsilanol pectinate, ascorbyl palmitate, ascorbyl stearate, BHA, p-hydroxyanisole, BHT, t-butyl hydroquinone, caffeic acid, Camellia sinensis Oil, chitosan ascorbate, chitosan glycolate, chitosan salicylate, chlorogenic acids, cysteine, cysteine HCl, citric acid, decyl mercaptomethylimidazole, erythorbic acid, diamylhydroquinone, di-t-butylhydroquinone, dicetyl thiodipropionate, dicyclopentadiene/t-butylcresol copolymer, digalloyl trioleate, dilauryl thiodipropionate, dimyristyl thiodipropionate, dioleyl tocopheryl methylsilanol, isoquercitrin, diosmine, disodium ascorbyl sulphsulphate, disodium rutinyl disulphsulphate, distearyl thiodipropionate, ditridecyl thiodipropionate, dodecyl gallate, ethyl ferulate, ferulic acid, hydroquinone, hydroxylamine HCl, hydroxylamine sulphsulphate, isooctyl thioglycolate, isopropyl citrate, kojic acid, madecassicoside, magnesium ascorbate, magnesium ascorbyl phosphate, melatonin, methoxy-PEG-7 rutinyl succinate, methylene di-t-butylcresol, methylsilanol ascorbate, nordihydroguaiaretic acid, octyl gallate, phenylthioglycolic acid, phloroglucinol, potassium ascorbyl tocopheryl phosphate, thiodiglycolamide, potassium sulphsulphite, propyl gallate, rosmarinic acid, rutin, sodium ascorbate, sodium ascorbyl/cholesteryl phosphate, sodium bisulphsulphite, sodium erythorbate, sodium metabisulphsulphide, sodium sulphsulphite, sodium thioglycolate, sorbityl furfural, tea tree (Melaleuca aftemifolia) oil, diethylenetriaminepentaacetic acid, tocopheryl acetate, tetrahexyldecyl ascorbate, tetrahydrodiferuloylmethane, tocopheryl linoleate/oleate, thiodiglycol, tocopheryl succinate, thiodiglycolic acid, thioglycolic acid, thiolactic acid, thiosalicylic acid, thiotaurine, retinol, tocophereth-5, tocophereth-10, tocophereth-12, tocophereth-18, tocophereth-50, tocopherol, tocophersolan, tocopheryl linoleate, tocopheryl nicotinate, tocoquinone, o-tolyl biguanide, tris(nonylphenyl) phosphite, ubiquinone, zinc dibutyldithiocarbamate, and mixtures thereof.

Examples of soil release agents include copolymeric blocks of terephthalate and polyethylene oxide or polypropylene oxide, and the like.

Examples of oxidizing agents are ammonium persulphsulphate, calcium peroxide, hydrogen peroxide, magnesium peroxide, melamine peroxide, potassium bromate, potassium caroate, potassium chlorate, potassium persulphsulphate, sodium bromate, sodium carbonate peroxide, sodium chlorate, sodium iodate, sodium perborate, sodium persulphsulphate, strontium dioxide, strontium peroxide, urea peroxide, zinc peroxide, and mixtures thereof.

Examples of reducing agents are ammonium bisufite, ammonium sulphsulphite, ammonium thioglycolate, ammonium thiolactate, cystemaine HCl, cystein, cysteine HCl, ethanolamine thioglycolate, glutathione, glyceryl thioglycolate, glyceryl thioproprionate, hydroquinone, p-hydroxyanisole, isooctyl thioglycolate, magnesium thioglycolate, mercaptopropionic acid, potassium metabisulphsulphite, potassium sulphsulphite, potassium thioglycolate, sodium bisulphsulphite, sodium hydrosulphite, sodium hydroxymethane sulphonate, sodium metabisulphite, sodium sulphite, sodium thioglycolate, strontium thioglycolate, superoxide dismutase, thioglycerin, thioglycolic acid, thiolactic acid, thiosalicylic acid, zinc formaldehyde sulphoxylate, and mixtures thereof.

Examples of propellant gases include carbon dioxide, nitrogen, nitrous oxide, volatile hydrocarbons such as butane, isobutane, or propane, and chlorinated or fluorinated hydrocarbons such as dichlorodifluoromethane and dichlorotetrafluoroethane or dimethylether; and mixtures thereof. Dispersibility aids may be used to facilitate dispersion of the compositions in the rinse water.

Examples of dispersibility aids include those selected from the group consisting of mono-alkyl cationic quaternary ammonium compounds, mono-alkyl amine oxides, and mixtures thereof.

Examples of inorganic salts include any inorganic salt known in the art for addition to fabric softener compositions. Non-limiting examples of suitable inorganic salts include: $MgI_2$, $MgBr_2$, $MgCl_2$, $Mg(NO_3)_2$, $Mg_3(PO_4)_2$, $Mg_2P_2O_7$, $MgSO_4$, magnesium silicate, NaI, NaBr, NaCl, NaF, $Na_3(PO_4)$, $NaSO_3$, $Na_2SO_4$, $Na_2SO_3$, $NaNO_3$, $NaIO_3$, $Na_4P_2O_7$, sodium silicate, sodium metasilicate, sodium tetrachloroaluminate, sodium tripolyphosphate (STPP), $Na_2Si_3O_7$, sodium zirconate, $CaF_2$, $CaCl_2$, $CaBr_2$, $CaI_2$, $CaSO_4$, $Ca(NO_3)_2$, KI, KBr, KCl, KF, $KNO_3$, $KIO_3$, $K_2SO_4$, $K_2SO_3$, $K_3(PO_4)$, $K_4(P_2O_7)$, potassium pyrosulphsulphate, potassium pyrosulphsulphite, LiI, LiBr, LiCl, LiF, $LiNO_3$, $ALF_3$, $AlCl_3$, $AlBr_3$, $Al_2(SO_4)_3$, $Al(PO_4)$, $Al(NO_3)_3$, aluminium silicate; including hydrates of these salts and including combinations of these salts or salts with mixed cations e.g. potassium alum $AlK(SO_4)_2$ and salts with mixed anions, e. g. potassium tetrachloroaluminate and sodium tetrafluoroaluminate. Salts incorporating cations from groups IIIa, IVa, Va, VIa, VIIa, VIII, Ib, and IIb on the periodic chart with atomic numbers >13 are also useful in reducing dilution. Salts with cations from group Ia or IIa with atomic numbers >20 as well as salts with cations from the lactinide or actinide series are useful in reducing dilution viscosity, and mixtures thereof.

Examples of antibacterial agents include chlorohexadiene gluconate, alcohol, benzalkonium chloride, benzethonium chloride, hydrogen peroxide, methylbenzethonium chloride, phenol, poloxamer 188, povidone-iodine, and mixtures thereof.

Examples of antifungal agents include miconazole nitrate, calcium undecylenate, undecylenic acid, zinc undecylenate, and mixtures thereof.

Examples of bleaching agents include chlorine bleaches such as chlorine, chlorine dioxide, sodium hypochlorite, calcium hypochlorite, sodium chlorate; peroxide bleaches such as hydrogen peroxide, sodium percarbonate, sodium perborate; reducing bleaches such as sodium dithionite, sodium borohydride; ozone; and mixtures thereof.

Examples of sequestering agents (also chelating agents) include phosphonates; amino carboxylic acid compounds (such as ethylenediamine tetraacetic acid (EDTA); N-hydroxyethylenediamine triacetic acid; nitrilotriacetic acid (NTA); and diethylenetriamine pentaacetic acid (DEPTA)); organo aminophosphonic acid compounds (such as ethylenediamine tetrakis (methylenephosphonic acid); 1-hydroxyethane 1,1-diphosphonic acid (HEDP); and aminotri (methylenephosphonic acid)); and mixtures thereof.

Examples of enzymes include lipases, cellulases, proteases, amylases, mannanases, pectate lyases, and mixtures thereof.

Diluents are often necessary to decrease the viscosity of the formulation sufficiently for application. The diluents of the fabric-care composition may be additional to or the same as the previously discussed extenders with respect to the polymer. Indeed the extender optionally provided in combination with the polymer may function as a diluent type fabric-care ingredient in the final fabric-care composition. Typically the optional diluent fabric-care ingredient may be selected from the list of alternative extenders here above.

Additional ingredients that may be used in the fabric-care compositions include antifoam compounds, builders, abrasives, fabric softeners, optical brighteners, soil-suspending agents, dispersants, dye transfer inhibitors, dye sequestrants, colour fixatives and anti-re-deposition agents.

The fabric-care ingredient(s) present in the fabric care composition are cumulatively present at a level of from 0.01% to 99.99% by weight, relative to the total weight of the fabric-care composition.

The fabric-care acceptable medium as hereinbefore described may include, but is not limited to, water, solvents, or mixtures and emulsions thereof. Solvents include low molecular weight organic solvents that are highly soluble in water, e.g., C1-C4 monohydric alcohols, C2-C5 polyhydric alcohols including alkylene glycols, polyalkylene glycols, alkylene carbonates, and mixtures thereof. Typical solvents include ethanol, propanol, isopropanol, n-butyl alcohol, t-butyl alcohol, ethylene glycol, diethylene glycol, propylene glycol, dipropylene glycol, glycerol, propylene carbonate, and mixtures thereof. Other suitable examples of fabric-care acceptable carriers include short chain polysiloxanes having a viscosity below 10 mPa·s, alternatively below 5 mPa·s, alternatively below 3 mPa·s, Cyclic polysiloxanes comprising 3 to 12 silicon atoms, alternatively comprising 4 to 7 silicon atoms, alternatively 4 to 6 silicon atoms, or blends thereof, organic mineral oils, organic polyesters and suitable blends of any of the above. The viscosity of these materials can be measured at 25° C. using any method known in the art as for example Wells/Brookfield™ Cone & Plate devices DV3TLVCP or DV2TLVCP or DV1MLVCP, equipped with cone-plate spindles suitable foe low viscosity as for example CPA-40Z, CPA-41Z, CPA-42Z. Details and ranges are available from www.brookfieldengineering.com.

The uncured silicone based polymer described herein may be introduced into a fabric-care composition, as also described herein, in any acceptable form. For example, it may be provided neat (undiluted), in a diluted form e.g. with extender as previously discussed or in an emulsion form, which may be prepared by any known method, e.g. by the methods as discussed below.

The fabric-care compositions comprising the uncured silicone based polymers as hereinbefore described may be prepared by a variety of methods. For example, the ingredients of the fabric care composition may be just mixed together. Alternatively the uncured silicone based polymers may be initially mixed with an acceptable medium, e.g. water, solvents and/or one or more diluents to form a solution, dispersion or emulsion prior to the addition of the one or more fabric care ingredients. In a further alternative the uncured silicone based polymers as hereinbefore described may be introduced into a preformed fabric care composition comprising one or more fabric care ingredients and an acceptable medium, e.g. water and/or one or more diluents with the resulting composition being mixed to form a solution, dispersion or emulsion. In a still further alternative the uncured silicone based polymers may be initially mixed with an acceptable medium, e.g. water, solvent and/or one or more diluents to form a solution, dispersion or emulsion which can be subsequently mixed with a solution, dispersion or emulsion of one or more fabric care ingredients with an acceptable medium, e.g. water and/or one or more solvents or diluents In some instances, the uncured silicone based polymer is used in conjunction with a fabric-care ingredient selected from a cationic conditioning agent, a hydrophobic conditioning agent, or mixtures thereof, in a fabric-care acceptable medium.

The uncured silicone based polymer described herein may be introduced into a fabric-care composition, as also described herein, in any acceptable form. For example, it may be provided neat (undiluted), in a diluted form e.g. with extender as previously discussed or in an emulsion form, which may be prepared by any known method, e.g. by the methods as discussed below.

A process for preparing an emulsion of the uncured silicone based polymer in water comprises the steps of:

I) forming a mixture comprising;
   A) 100 parts by weight of uncured silicone based polymer as hereinbefore described,
   B) 0.1 to 50 parts by weight of a surfactant,
II) admixing a sufficient amount of water to the mixture from step 1) to form an emulsion having a continuous phase and a dispersed phase,
III) optionally, further shear mixing the emulsion and/or diluting of the emulsion with the continuous phase.

The amount of surfactant (which, as indicated above, is a suitable fabric-care ingredient) added in step (I) should be 0.1 to 50 parts by weight, alternatively 1 to 50 parts by weight, alternatively 2 to 20 parts by weight, for every 100 parts by weight of uncured silicone based polymer.

Mixing in step (I) can be accomplished by any suitable method in the art to effect mixing of an emulsion. The mixing may occur as a batch, semi-continuous, or continuous process. Mixing may occur, for example using, batch mixing equipment with medium/low shear include change-can mixers, double-planetary mixers, conical-screw mixers, ribbon blenders, double-arm or sigma-blade mixers; batch equipment with high-shear and high-speed dispersers include those made by Charles Ross & Sons (NY), Hockmeyer Equipment Corp. (NJ); batch equipment with high shear actions include Banbury-type (CW Brabender Instruments Inc., NJ) and Henschel type (Henchel mixers America, TX); centrifugal force-based, high shear mixing devices as for example Speed Mixer® (Hauschild & Co KG, Germany). Illustrative examples of continuous mixers/compounders include extruders single-screw, twin-screw, and multi-screw extruders, co-rotating extruders, such as those manufactured by Krupp Werner & Pfleiderer Corp (Ramsey, N.J.), and Leistritz (NJ); twin-screw counter-rotating extruders, two-stage extruders, twin-rotor continuous mixers, dynamic or static mixers or combinations of this equipment.

The temperature and pressure at which the mixing of step (I) occurs is not critical, but generally is conducted at ambient temperature (20-25° C.) and pressures. Typically, the temperature of the mixture will increase during the mixing process due to the mechanical energy associated when shearing such high viscosity materials.

Step (II) of the process involves admixing water to the product of step (I) to form an emulsion. Typically 5 to 2000 parts by weight of water are introduced per every 100 parts by weight of the product of product of step (I) to form an emulsion. The water is added to the product of step (I) at a suitable rate, with additional mixing, so as to form an emulsion with the product of step (I). While this amount of water can vary depending on the selection of the surfactants, generally the amount of water is from 0.1 to 2000 parts per 100 parts by weight of the product of step (I), alternatively from 5 to 500 parts per 100 parts by weight of the product of step 1, or alternatively from 5 to 100 parts per 100 parts by weight of the product of step (I).

The addition of water to the product of step (I) may be done in incremental portions, whereby each incremental portion comprises less than 30 weight % of the mixture from step (I) and each incremental portion of water is added successively to the previous after the dispersion of the previous incremental portion of water, wherein sufficient incremental portions of water are added to form an emulsion with the uncured silicone based polymer.

Mixing in step (II) can be accomplished by any method known in the art to effect mixing of high viscosity materials. The mixing may occur either as a batch, semi-continuous, or continuous process. Any of the mixing methods as described for step (I), may be used to effect mixing in step (II). Alternatively, mixing in step (II) may also occur via those techniques known in the art to provide high shear mixing to effect formation of emulsions. Representative of such high shear mixing techniques include: homogenizers, sonolators, and other similar shear devices.

Optionally, the emulsion formed in step (II) may be further sheared according to step (III) to reduce particle size and/or improve long term storage stability. The shearing may occur by any of the mixing techniques discussed above. In some cases it might be necessary to run one or several of the steps (I) to (III) under lower pressure or vacuum.

Alternatively an emulsion of the uncured silicone based polymer in water may be prepared by; (I) forming a mixture comprising;

A) 100 parts by weight of uncured silicone based polymer as hereinbefore described;

B) an optional diluent;

C) 0.1 to 50 parts by weight of a surfactant, (II) admixing a sufficient amount of water with the product from step (I) to form an emulsion having a continuous phase and a dispersed phase, (III) optionally, further shear mixing the emulsion and/or diluting the emulsion with the continuous phase.

In this alternative process, the mixing and addition conditions remain as disclosed for the first process. The reaction conditions are also as discussed above. The diluent may be a diluent as hereinbefore described but may also be an extender as hereinbefore described.

The above two methods provide methods for making the fabric-care composition in which the surfactant and diluent, when present are the fabric-care ingredients. However, the above may also be a partial preparation step as a means of introducing the uncured silicone based polymer into other ingredients of a composition.

The fabric-care composition may be prepared by a process comprising the steps of i. Mixing uncured silicone based polymer as hereinbefore described ii. and at least one fabric-care ingredient, optionally in the presence of an acceptable medium.

The uncured silicone based polymer may be provided in any suitable form, i.e. it may be in a "neat" or undiluted form, in an extended form (i.e. in a mixture with an extender as described above) or in the presence of a fabric-care acceptable medium, e.g. in an emulsion. The fabric-care composition may be prepared in the form of the emulsion when mixing the above ingredients together.

The emulsions of the present disclosure may be an oil/water emulsion, a water/oil emulsion, a multiple phase or triple emulsion. The emulsions may be prepared using the mixing apparatus described above.

In one embodiment, the emulsions of the present disclosure are oil/water emulsions. The present oil/water emulsions may be characterized by average volume particle of the dispersed (oil) phase in the continuous aqueous phase. The particle size may be determined by laser diffraction of the emulsion. Suitable laser diffraction techniques are well known in the art. The particle size is obtained from a particle size distribution (PSD). The PSD can be determined on a volume, surface, length basis. The volume particle size is equal to the diameter of the sphere that has the same volume as a given particle. The term Dv represents the average volume particle size of the dispersed particles. Dv 0.5 is the particle size measured in volume corresponding to 50% of the cumulative particle population. In other words if Dv 0.5=10 μm, 50% of the particle have an average volume particle size below 10 μm and 50% of the particle have a volume average particle size above 10 μm. Unless indicated otherwise all average volume particle sizes are calculated using Dv 0.5.

The average volume particle size of the dispersed siloxane particles in the oil/water emulsions may vary between 0.1 μm and 150 μm; or between 0.1 μm and 30 μm; or between 0.2 μm and 5.0 μm.

In one embodiment of this invention the composition can be formulated as a serum. For the purpose of this invention "serum" is defined as a blend of the uncured silicone based polymer with at least one low viscosity fabric-care acceptable carrier, preferably a volatile one, e.g. one of the solvents as described above, and also containing at least one fabric-care ingredient.

The fabric-care compositions may be prepared by mixing the uncured silicone based polymer in the appropriate phase of the final fabric-care composition.

When the uncured silicone based polymer is used in emulsion form, it may be mixed with the aqueous phase ingredients and optionally subsequently mixed with an optional second hydrophobic phase. When there are multiple phases, the different phases may subsequently be mixed together, optionally under heating.

When the uncured silicone based polymer is used in emulsion form, it may be mixed with the aqueous phase ingredients and optionally subsequently mixed with an optional second hydrophobic phase.

When there are multiple phases, the different phases may subsequently be mixed together, optionally under heating. The process may be conducted at temperatures ranging of from 15 to 90° C., alternatively of from 20 to 60° C., alternatively at room temperature (25° C.), using simple propeller mixers, counter-rotating mixers, or homogenizing mixers. No special equipment or processing conditions are typically required. Depending on the type of composition prepared, the method of preparation will be different, but such methods are well known in the art.

The fabric care compositions comprising the uncured silicone based polymer may be adapted for use in a washing machine or for use when hand washing. The fabric care compositions according to the present invention may be in liquid, paste, laundry bar, or granular form. Other forms of the fabric care compositions include creams, gels, foams, sprays or aerosols. The fabric care compositions may be in the form of monophasic systems, biphasic or alternate multi phasic systems; emulsions, e.g. oil-in-water, water-in-oil, silicone-in-water, water-in-silicone; multiple emulsions, e.g. oil-in-water-in-oil, polyol-in-silicone-in-water, oil-in-water-in-silicone.

A laundry process is necessary in order to remove dirt, stains and malodours from fabrics or textiles, in particular clothes and household fabrics. However, the laundry process involves harsh conditions which often result in damage to the fabric such as fabric pilling, shrinkage and loss of colour intensity and/or loss of colour definition.

A fabric-softening composition may be used in the laundry process to prevent static cling in a laundered fabric and thereby make the fabric softer. Colour-care additive are meant to retain the integrity of its colour, for example the intensity and shade of colour of the fabric.

The uncured silicone based polymer may be used in a liquid, pourable form, or may be granulated/agglomerated to be combined in solid fabric care compositions.

When provided in a granular form, the granular compositions may be made by combining base granule ingredients, e. g., surfactants, builders, water, etc., as a slurry, and spray drying the resulting slurry to a low level of residual moisture (5-12%). In some instances, additional ingredients may be added during the granulation process such as colour-care additive, and fragrances.

The fabric care compositions may be prepared by admixing the uncured silicone based polymer with other liquid ingredients of the fabric care compositions. When solid, the fabric care compositions may be prepared by admixing the granulated form in bi-modal water continuous emulsions with the further ingredients, or by spray drying/agglomerating liquid fabric care compositions comprising the uncured silicone based polymer.

Benefits obtained from using a fabric care composition comprising uncured silicone based polymer include: fabric softening and/or feel enhancement, garment shape retention and/or recovery and/or elasticity, ease of ironing, colour care, anti-abrasion, anti-pilling, silicone deposition, water absorbency, reduction and/or removal and/or prevention of wrinkles fabric enhancement (or conditioning), or any combination thereof. In a dyeing process, benefits include colour fastness, colour absorbency, colour long lasting.

The invention also comprises a method of treating fabric substrates and fibres, by applying to it a fabric care composition according to the first aspect of the invention.

A process of washing fabric substrates and fibres comprises the steps of i. Mixing an uncured silicone based polymer as hereinbefore described with at least one fabric care ingredient optionally in the presence of an acceptable medium,
ii. Applying the mixture to the fabric substrates and fibres;
iii. Optionally let the mixture stand on the fabric substrates and fibres;
iv. Optionally rinsing the fabric substrates and fibres.

A process of conditioning fabric substrates and fibres comprises the steps of i. Mixing an uncured silicone based polymer as hereinbefore described with at least one fabric care ingredient optionally in the presence of an acceptable medium;
ii. Applying the mixture to the fabric substrates and fibres;
iii. Optionally let the mixture stand on the fabric substrates and fibres;
iv. Optionally rinsing the fabric substrates and fibres.

The optional standing time of the process of caring or conditioning fabric substrates and fibres may range from 10 seconds to 24 hours, alternatively from 10 minutes to 12 hours, alternatively from 10 minutes to 3 hours, alternatively from 10 minutes to 1 hour.

In one embodiment, the present invention provides for the use of the present fabric care composition to care for fabric substrates, i.e. to cleanse, to condition and/or to refresh fabric.

The fabric-care compositions may be in the form of a cream, a gel, a powder (free flowing powder or pressed), a paste, a solid, freely pourable liquid, an aerosol. The fabric-care compositions may be in the form of monophasic systems, biphasic or alternate multiphasic systems; emulsions, e.g. oil-in-water, water-in-oil, silicone-in-water, water-in-silicone; multiple emulsions, e.g. oil-in-water-in-oil, polyol-in-silicone-in-water, oil-in-water-in-silicone.

The fabric-care compositions as hereinbefore described may be used in laundry processes to remove dirt, stains and malodours from fabrics or textiles, in particular clothes and household fabrics. However, the laundry process involves harsh conditions which often result in damage to the fabric such as fabric pilling, shrinkage and loss of colour intensity and/or loss of colour definition. Hence, they may be used as liquid detergents, solid detergents, pre-wash treatments, fabric softeners, colour care treatments and the like, used in the care of fabric and fibres, that is, any product adapted to be applied to a fibre, fabric or textile e.g. clothing, in order to improve the appearance or condition of the fabric or textile. Fabric-softening compositions in the laundry process are used to prevent static cling in a laundered fabric and thereby make the fabric softer. Colour-care compositions are used to retain the integrity of its colour, for example the intensity and shade of colour of the fabric.

Hence, benefits obtained from using a fabric-care composition comprising an uncured silicone based polymer as hereinbefore described include fabric softening and/or feel enhancement, garment shape retention and/or recovery and/or elasticity, ease of ironing, colour care, anti-abrasion, anti-pilling, silicone deposition, water absorbency, reduction and/or removal and/or prevention of wrinkles fabric enhancement (or conditioning), or any combination thereof. In a dyeing process, benefits include colour fastness, colour absorbency, colour long lasting.

The fabric care compositions may be applied on to fibres, fabrics and textiles which may be made of animal, vegetal or synthetic origin. The fiber surfaces include various textile and natural fibers. Fibers or textiles that can be treated with the treatment composition include natural fibers such as cotton, silk, linen, wool, angora, mohair, cashmere; regenerated fibers such as rayon and acetate; synthetic fibers such as polyesters, polyamides, polyacrylonitriles, polyethylenes, and polypropylenes; combinations, and blends thereof. The form of the fibers can include threads, filaments, tows, yarns, woven fabrics, knitted materials, non-woven materials, paper, carpet, and leather.

Fiber treatment composition comprising the present compositions may be applied to the fiber and/or textile during making the fibers or textiles, or later via a post application process. After application, carriers (if any) can be removed from the treatment composition for example by drying the composition at ambient or elevated temperature. The amount of treatment composition applied to the fibers and textiles is typically sufficient to provide 0.1 to 15 weight percent of the composition on the fibers and textiles, based on their dry weight, preferably in an amount of 0.2 to 5 weight percent based on the dry weight of the fiber or textile.

EXAMPLES

The following examples are provided to demonstrate preferred embodiments of the invention. Unless otherwise indicated, all recipes are in mass parts, and not %, therefore the sum is not necessarily 100.

Table 1 lists the ingredients used to prepare emulsions for these examples. Comp. 1 is a comparative example and Ex. 1, 2 and 3 and Examples as described herein. In Comp. 1 the polymer is a trimethyl terminated polydimethylsiloxane. In Ex. 1 to Ex. 3 the polymers are in accordance with the undiluted silicone polymer as described above wherein $$(R^1O)_{3-x}—Si(R^2)_x—(Z)_d—(O)_q—(R^3{}_2SiO)_N—(SiR^3{}_2—Z)_d—Si(R^2)_y(OR^1)_{3-y}$$

In which:

x is 0 (zero) or 1;

y is 0, 1, 2, or 3;

N is from 300 to 10,000;

d is 0 or 1, q is 0 or 1, and d+q=1; $R^1$, $R^2$ and $R^3$ are each independently linear alkyl groups containing 1 to 10 carbons; and each Z is an ethylene unit Brij© L23, is a ethoxylated alcohol surfactant known as polyoxyethylene (23) lauryl ether, and Brij® LT4 is another ethoxylated alcohol surfactant known as polyoxyethylene (4) lauryl ether. Both are commercially available materials from Croda.

The polymer and surfactant(s) were added into a receptacle suitable for use with the Hauschild Mixer type DAC 150.1 FV. The polymer and surfactants were then mixed using the Hauschild Mixer type DAC 150.1 FV to homogeneity by mixing for 30 s at 3500 revolutions per minute (rpm). The inversion water was then added and a thick emulsion was obtained upon shearing for 1 min at 3500 rpm. Three successive additions of "dilution" water were made to dilute the thick emulsion, each addition being followed by a mixing step of 30 s at 3500 rpm.

The particle sizes (D(v, 0.5) and D(v, 0.9)) of the disperse phase were measured at the end of the process using Malvern Mastersizer 3000 instrument from Malvern Instruments Ltd., UK. (Further information on the particle size determination can be found in "Basic Principles of Particle Size Analytics", Dr. Alan Rawle, Malvern Instruments Limited, WR14 1XZ, UK and the "Manual of Malvern Particle Size Analyser". Particular reference is made to the user manual number MNA 0096, Issue 1.0, November 1994. All particle sizes indicated in the present application are mean average particle size according to the aforementioned D(v, 0.5) and D(v, 0.9). D(v, 0.5) is a volume diameter of the disperse phase "particles" determined by the instrument indicating that 50% of the disperse phase particle population resides below the value identified and the other 50% is above said value. Similarly in the case of D(v, 0.9) the instrument identifies a value whereby 90% of the disperse phase particle population resides below the value identified and the other 10% is above said value.

TABLE 1

| Sample Code | Comp. 1 | Ex. 1 | Ex. 2F3 | Ex. 3F4 |
|---|---|---|---|---|
| Viscosity, mPa · s at 25° C. | 60000 | 110 000 | 60000 | 60000 |
| End groups | tri-methyl | tri-ethoxy and trimethyl x = 0 and y = 0 or 3 such that 75% (mol) of the chain ends are triethoxy | tri-ethoxy (x = 0 and y = 0) | tri-methoxy (x = 0 and y = 0) |
| Silicone Polymer (g) | 10 | 10 | 10.06 | 10.08 |
| Brij LT4 (g) | 0.6 | 0.58 | 0.59 | 0.59 |
| Brij LT23 (g) | 0.58 | 0.6 | 0.58 | 0.59 |
| Inversion water (g) | 1.39 | 1.04 | 1.11 | 1.01 |
| Dilution water (g) | 2.23 | 2.59 | 2.63 | 2.59 |
| Dilution water (g) | 2.28 | 2.72 | 2.61 | 2.61 |
| Dilution water (g) | 2.63 | 2.56 | 2.61 | 2.62 |
| Total (g) | 19.71 | 20.09 | 20.19 | 20.09 |
| Final Si Content (mass %) | 50.74 | 49.78 | 49.83 | 50.17 |
| particle size Dv(0.5) (μm) | 2.249 | 2.552 | 1.932 | 1.689 |
| particle size Dv(0.9) (μm) | 3.634 | 4.036 | 3.061 | 2.692 |

The emulsions prepared above were then analyzed to identify the amount of silicone deposited on the surface of standardized pieces of knitted cotton fabric (50 g each) following a standard protocol using the following steps:

Fabrics Pre-Conditioning

Pre-conditioning of the fabric samples was undertaken to ensure that residues of any treatment which had previously taken place e.g. during manufacture is at least substantially and preferably completely removed so that it can be reasonably anticipated that the fabric samples were free of silicone before treatment with the samples as hereinbefore described.

3 kg of the knitted cotton fabric (50 g each) were pre-washed in a Commercial Electrolux® washing machine with 40 g of detergent powder added in a first washing cycle at 90° C. and 1400 revolutions per minute (rpm) followed by six cumulative "blank cycles" e.g. without detergent at 90° C. and 1400 rpm.

Pre-conditioned samples having undergone the above were then washed and rinsed using the comp. 1 and Ex. 1 to 3 emulsions described above using the following steps:

Wash Step:

A liter of water having a hardness of 0 dH (1 degree of German Hardness (dH) 10 mg/L CaO) and temperature of 40° C. was introduced into a 2 L beaker. Silicone emulsion was added in an amount such that the final silicone content in water is 0.25% by weight.

To this mixture was added 5 g of liquid detergent (5 g) and the resulting mixture was well homogenized. Four pieces of the pre-conditioned knitted cotton fabric were introduced into the beaker and soaked without stirring for a period of 5 minutes.

Rinse Step:

The four pieces of knitted cotton fabric were introduced into a 2 L beaker containing a liter of water (hardness 0 dH, temperature 40° C.) and rinsed without stirring for a period of 3 minutes. After rinsing the pieces of knitted cotton fabric were removed one by one, squeezed to drain water and line dried for approximately 2-3 hours.

In the case of "wash only samples" the fabric pieces did not undergo the rinse step (drainage and rinsing) but were line dried for 2 to 3 hours immediately after completion of the washing step. In the case of samples which were washed and rinsed they underwent both the washing step and the rinse step described above.

X-ray fluorescence (XRF) spectroscopy was then used to determine the total silicon deposited on the fabric samples tested. This important because it is a means of predicting the level of silicone deposition onto the surface of cotton fabric garments if used in a washing composition. XRF is an atomic emission method in which wavelength and intensity of X-rays emitted by energized atoms in the sample is measured. The irradiation by a primary X-ray beam from an X-ray tube, causes emission of fluorescent X-rays with discrete energies characteristic of the elements present in the sample. Thus one can obtain both the chemical composition and (by means of a calibration curve) the content of each element.

After the above drying step XRF cups were prepared with slightly moist fabrics. The cups were further dried for a period of 48 hours before XRF analysis.

The X-ray Fluorescence analysis was undertaken using a PANalytical Axios 2.4 kW sequential Wavelength Dispersive X-ray Fluorescence (WDXRF) spectrometer, with a Rh-end window tube (75 μm Be end-window), power settings of 24 kV and 100 mA, curved InSb111-c crystal (special monochromator for ultra-high sensitivity and improved resolution of Si), a 700 μm primary collimator, beam filter 150 μm Beryllium, gas flow detector and 120 seconds irradiation time.

A sample spinner was used to rotate the sample during the analysis and helped to minimize the effects of any inhomogeneity in the sample. The same base fabric (same composition, weaving & thickness) was used as baseline. The spectrometer was operated in helium analysis medium (20 sec medium flush time). Net fluorescence intensities of the Si Kα-line was related to the amount of silicone polymers deposited onto fabric specimens by comparing signals obtained from treated and untreated samples.

After the above line drying step, XRF cups were prepared with slightly moist fabrics. Each fabric material was cut to square-shaped specimens to fit into a standard 40 mm diameter size XRF cup and was then used to close the cup instead of the original thin-film sample support.

The fabric sample was initially grasped and held taut at all points of contact by a bead and was temporally stretched until the bead finally locks in the cell neck. If the fabric support was positioned properly it is wrinkle-free and taut. During the preparation of the XRF cups, it is primordial to prevent the fabric sample from contact and contamination. For each sample, four specimens were prepared in XRF cups the results in Table 2 are averages.

The difference of the values between the XRF Si signal from "Wash, Rinse, Dry" (referred to in Table 2 as "WRD") and "Wash Only" (referred to in Table 2 as "WO") experiments was determined and is expressed in Table 2 as a percentage. The higher the value the higher the amount of silicone deposited on the fabric. The units Kcps are kilocounts per second.

TABLE 2

| Si (active content) | 0.25% Comp. 1 WO | 0.25% Comp. 1 WRD | 0.25% Ex. 1 WO | 0.25% Ex. 1 WRD | 0.25% Ex. 2 WO | 0.25% Ex. 2 WRD | 0.25% Ex. 3 WO | 0.25% Ex. 3 WRD |
|---|---|---|---|---|---|---|---|---|
| XRF signal (Kcps) | 11.29 | 1.74 | 8.53 | 2.21 | 13.33 | 2.84 | 11.31 | 2.21 |
| % silicone deposit | | 15% | | 26% | | 21% | | 20% |

It can be seen that a better deposition is observed for Examples 1, 2 and 3 compared to Comparative 1.

The invention claimed is:

1. A fabric-care composition comprising an uncured silicone based polymer; and at least one fabric-care ingredient, optionally in a fabric-care acceptable medium; wherein the uncured silicone based polymer is linear or branched and has the general formula:

$$(R^1O)_{3-x}—Si(R^2)_x—(Z)_d—(O)_q—(R^3{}_2SiO)N—(SiR^3{}_2—Z)_d—Si(R^2)_y(OR^1)_{3-y}$$

where:

x is 0 or 1;

y is 0, 1, 2, or 3;

N is from 300 to 10,000;

d is 1 and q is 0;

$R^1$, $R^2$ and $R^3$ are each independently linear alkyl groups containing 1 to 10 carbons; and each Z is independently either (i) a linear or branched alkylene group having from 1 to 12 carbon atoms which may be interrupted by one or more linear or branched siloxane groups comprising from 1 to 20 silicon atoms; or (ii) an organic chain based on polyoxyalkylene based units which may be interrupted by one or more linear or branched siloxane groups comprising from 1 to 20 silicon atoms.

2. The fabric-care composition of claim 1, wherein y is 0, 3, or a mixture of 0 and 3.

3. The fabric-care composition of claim 2, wherein x is 0.

4. The fabric-care composition of claim 1, wherein the uncured silicone based polymer is in neat form, in diluted form, or in emulsion form.

5. The fabric care composition of claim 1, wherein the fabric care ingredient is selected from the group consisting of surface active materials, surfactants, detergents, emulsifiers, thickeners, water phase stabilizing agents, pH controlling agents, preservatives and biocides, proteins or amino-acids and their derivatives, pigments, colourants, silicone conditioning agents, cationic conditioning agents, non-ionic conditioning agents, hydrophobic conditioning agents, UV absorbers, sunscreen agents, dyes, fragrances or perfume, antioxidants, soil release agents, oxidizing agents, reducing agents, propellant gases, dispersibility aids, inorganic salts, antibacterial agents, antifungal agents, bleaching agents, sequestering agents, enzymes, antifoam compounds, builders, abrasives, fabric softeners, optical brighteners, soil-suspending agents, dispersants, dye transfer inhibitors, dye sequestrants, colour fixatives, anti-re-deposition agents, fatty alcohols, colour care additives, ironing agents, suspending agents, and combinations thereof.

6. The fabric care composition of claim 1, wherein the fabric care ingredient is selected from the group consisting of cationic conditioning agents, non-ionic conditioning agents, hydrophobic conditioning agents, and combinations thereof.

7. The fabric care composition of claim 1, which is in the form of a liquid, a paste, a laundry bar, granules, a cream, a gel, a foam, a spray, or an aerosol.

8. The fabric care composition of claim 1, which is in the form of a monophasic system, a biphasic system, or a multi phasic system.

9. The fabric care composition of claim 8, which is in the form of an emulsion, and wherein the emulsion is oil-in-water, water-in-oil, silicone-in-water, or water-in-silicone; or is in the form of a multiple emulsion, and optionally wherein the multiple emulsion is oil-in-water-in-oil, polyol-in-silicone-in-water, or oil-in-water-in-silicone.

10. The fabric care composition according to claim 1, wherein the fabric-care acceptable medium is present.

11. The fabric-care composition of claim 1, wherein x is 0.

12. A process for preparing the fabric care composition according to claim 1, said method comprising mixing the uncured silicone based polymer and the at least one fabric care ingredient, optionally in the presence of the fabric-care acceptable medium.

13. A process for the treatment of fabric substrates and fibres, said method comprising:

providing the fabric care composition according to claim 1; and applying the fabric care composition to the fabric substrates and fibres;

optionally, letting the fabric care composition stand on the fabric substrates and fibres;

optionally, rinsing the fabric substrates and fibres.

14. The process according to claim 13, further defined as a process of conditioning fabric substrates and fibres.

15. A process for the treatment of fabric substrates and fibres, said method comprising:

providing a fabric care composition; and applying the fabric care composition to the fabric substrates and fibres;

optionally, letting the fabric care composition stand on the fabric substrates and fibres;

optionally, rinsing the fabric substrates and fibres;

wherein the fabric-care composition comprises an uncured silicone based polymer; and at least one fabric-care ingredient, optionally in a fabric-care acceptable medium; and wherein the uncured silicone based polymer is linear or branched and has the general formula:

$$(R^1O)_{3-x}—Si(R^2)_x—(Z)_d—(O)_q—(R^3{}_2SiO)_N—(SiR^3{}_2—Z)_d—Si(R^2)_y(OR^1)_{3-y}$$

where:

x is 0 or 1;

y is 0, 1, 2, or 3;

N is from 300 to 10,000;

d is 0 or 1, q is 0 or 1, and d+q=1;

$R^1$, $R^2$ and $R^3$ are each independently linear alkyl groups containing 1 to 10 carbons; and each Z is independently either (i) a linear or branched alkylene group having from 1 to 12 carbon atoms which may be interrupted by one or more linear or branched siloxane groups comprising from 1 to 20 silicon atoms; or (ii) an organic chain based on polyoxyalkylene based units which may be interrupted by one or more linear or branched siloxane groups comprising from 1 to 20 silicon atoms.

* * * * *